US010704434B2

(12) United States Patent
Akita et al.

(10) Patent No.: US 10,704,434 B2
(45) Date of Patent: Jul. 7, 2020

(54) BLOW-BY GAS HEATING APPARATUS

(71) Applicant: KUBOTA Corporation, Osaka-shi, Osaka (JP)

(72) Inventors: Mitsuhiro Akita, Sakai (JP); Kohei Sawada, Sakai (JP)

(73) Assignee: KUBOTA Corporation, Osaka-Shi, Osaka (JP)

( * ) Notice: Subject to any disclaimer, the term of this patent is extended or adjusted under 35 U.S.C. 154(b) by 0 days.

(21) Appl. No.: 16/305,932

(22) PCT Filed: Aug. 31, 2017

(86) PCT No.: PCT/JP2017/031326
§ 371 (c)(1),
(2) Date: Nov. 30, 2018

(87) PCT Pub. No.: WO2018/043635
PCT Pub. Date: Mar. 8, 2017

(65) Prior Publication Data

US 2019/0218947 A1 Jul. 18, 2019

(30) Foreign Application Priority Data

Sep. 2, 2016 (JP) ..... 2016-171699

(51) Int. Cl.
*F01M 5/02* (2006.01)
*F01M 13/00* (2006.01)
*F01M 13/04* (2006.01)

(52) U.S. Cl.
CPC ..... *F01M 5/021* (2013.01); *F01M 13/00* (2013.01); *F01M 2005/023* (2013.01);
(Continued)

(58) Field of Classification Search
CPC .. F01M 5/021; F01M 13/00; F01M 2005/023; F01M 2013/0027;
(Continued)

(56) References Cited

U.S. PATENT DOCUMENTS 6,415,778 B1 * 7/2002 Makino ..... F01M 5/021 123/572
7,942,122 B2 * 5/2011 Shieh ..... F01M 13/0416 123/572
(Continued)

FOREIGN PATENT DOCUMENTS

DE 102013021983 A1 6/2015
EP 0898060 A1 2/1999
(Continued)

OTHER PUBLICATIONS

European Search Report dated Nov. 20, 2020 in European Application No. EP 17846639.7.
(Continued)

*Primary Examiner* — Syed O Hasan
(74) *Attorney, Agent, or Firm* — Panitch Schwarze Belisario & Nadel LLP

(57) ABSTRACT

As a further improvement of the technique of minimizing or preventing excessive cooling of an oil separator, an effective blow-by gas heating apparatus which minimizes or solves the problems due to frozen blow-by gas in an engine externally equipped with an oil separator is provided. The blow-by gas heating apparatus includes: a heat emitting structure abutted onto an oil separator configured to trap and remove oil from blow-by gas. The heat emitting structure has a heat emitting case including inside a passage for engine cooling water. The heat emitting case includes a ceiling wall being in surface-contact from below with a bottom surface of the oil separator.

4 Claims, 10 Drawing Sheets

(52) U.S. Cl.
CPC ..... *F01M 2013/0027* (2013.01); *F01M 2013/0438* (2013.01); *F01M 2013/0455* (2013.01); *F01M 2013/0472* (2013.01)

(58) Field of Classification Search
CPC ... F01M 2013/0438; F01M 2013/0455; F01M 2013/0472
See application file for complete search history.

(56) References Cited

U.S. PATENT DOCUMENTS

| | | | | |
|---|---|---|---|---|
| 7,966,997 | B2 * | 6/2011 | Ito | F01M 13/04 123/54.4 |
| 2015/0114368 | A1 | 4/2015 | Kurita et al. | |
| 2017/0002784 | A1 * | 1/2017 | Plenk | F02N 19/10 |

FOREIGN PATENT DOCUMENTS

| | | | |
|---|---|---|---|
| EP | 1965045 | A2 | 9/2008 |
| JP | 2001-073738 | A | 3/2001 |
| JP | 2006299932 | A | 11/2006 |
| JP | 2007-247552 | A | 9/2007 |
| JP | 2014-211088 | A | 11/2014 |
| JP | 2015-110935 | A | 6/2015 |

OTHER PUBLICATIONS

Int'l Search Report dated Oct. 31, 2017 in Int'l Application No. PCT/JP2017/031326.

* cited by examiner (a)

(b)

BLOW-BY GAS HEATING APPARATUS

CROSS-REFERENCE TO RELATED APPLICATION

This application is a Section 371 of International Application No. PCT/JP2017/031326, filed Aug. 31, 2017, which was published in the Japanese language on Mar. 8, 2018 under International Publication No. WO 2018/043635 A1, which claims priority under 35 U.S.C. § 119(b) to Japanese Application No. 2016-171699, filed Sep. 2, 2016, the disclosures of which are incorporated herein by reference in their entirety.

TECHNICAL FIELD

The present invention relates to a blow-by gas heating apparatus mounted on a blow-by gas return apparatus-equipped engine for an industrial or traveling vehicle. Specifically, the present invention relates to a blow-by gas heating apparatus including a heat emitting structure abutted onto an oil separator that traps and removes oil from blow-by gas.

BACKGROUND ART

Blow-by gas is leakage of an air-fuel mixture or combustion gas from a combustion chamber of an internal combustion engine into a crankcase through a gap between a piston and a cylinder (specifically, through a gap between a piston ring and a cylinder). That is, blow-by gas contains unburned gas, exhaust gas, and what is called oil mist, which is a mixture of the foregoing and engine oil (hereinafter simply referred to as the oil). The entry of the blow-by gas into the crankcase causes deterioration of the engine oil, corrosion of metal, and contamination of the atmosphere.

Addressing thereto, what is generally practiced is provision of a blow-by gas return apparatus, that is, a mechanism that returns blow-by gas accumulated in the crankcase to an intake passage, so that the returned blow-by gas is mixed with a new air-fuel mixture and burned and thereby prevented from being released into the atmosphere as it is. However, since blow-by gas contains not only oil mist but also moisture contained in exhaust gas, in some cases, returning the blow-by gas into the intake passage as it is works adversely.

In view of the foregoing, a blow-by gas return apparatus is provided with an oil separator for trapping and removing mainly an oil component in blow-by gas, in order to remove liquid components such as oil (oil mist) and water contained in blow-by gas as much as possible and return the blow-by gas to the intake passage. There exists known engine that is externally equipped with an oil separator as an independent component, which is disclosed in Patent Documents 1 and 2. Patent Document 1 discloses the oil separator as a ventilator (2), and Patent Document 2 discloses the oil separator as a ventilator apparatus (1).

The blow-by gas return apparatus including a pipe for returning blow-by gas to the intake passage is basically externally mounted on an engine and exposed outside and, therefore, tends to be susceptible to cold. That is, under an extremely low temperature condition such as −20° C. to −30° C. in northern countries in winter, cooled blow-by gas makes moisture in the blow-by gas freeze, possibly resulting in clogging.

Particularly, an oil separator externally mounted on an engine has a large surface area and tends to be cooled, inviting freezing of moisture in the blow-by gas contained therein. The frozen moisture not only hinders the blow-by gas returning function, but also may clog the retuning port for trapped oil, inviting an excessive accumulation of the oil inside the oil separator, whereby the oil separation function is hindered. Also, the clogging may increase the internal pressure in the crankcase, which may result in unexpected oil leakage.

Addressing the problems, as disclosed in FIG. 1 of Patent Document 2, there is known a technique of providing an antifreeze cover (26) including an insulator member (28) covering the outside of the bottom wall of an oil separator, thereby preventing the inside of the oil separator from being excessively cooled.

PRIOR ART DOCUMENTS

Patent Documents

Patent Document 1: Japanese Patent Application Laid-open No. 2014-211088

Patent Document 2: Japanese Patent Application Laid-open No. 2007-247552

SUMMARY OF THE INVENTION

Problems to be Solved by the Invention

The technique disclosed in Patent Document 2, which is the provision of an antifreeze cover, exhibits the effect to some extent. Still, it is easily expected that the antifreeze effect will be poor under rigorous conditions where the antifreeze cover is exposed in low temperatures for long hours such as in starting the engine of a working machine in the next morning following the day the working machine was operated, or in extremely low temperatures. Thus, the technique still needs further improvements.

The present invention has been made as a further improvement of the technique of minimizing or preventing excessive cooling of an oil separator, and an object thereof is to provide an effective blow-by gas heating apparatus which minimizes or solves the above-described problems due to frozen blow-by gas in an engine externally equipped with an oil separator.

Solutions to the Problems

An inventive aspect according to claim 1 is a blow-by gas heating apparatus including a heat emitting structure 19 abutted onto an oil separator 9 configured to trap and remove oil from blow-by gas. The heat emitting structure 19 has a heat emitting case 20 including inside a passage 21 for engine cooling water. The heat emitting case 20 includes a ceiling wall 22 being in surface-contact from below with a bottom surface 16A of the oil separator 9.

In an inventive aspect according to claim 2, in the blow-by gas heating apparatus according to claim 1, a height of an inner surface 22B of the ceiling wall 22 is configured to increase from a central part toward a peripheral part of the heat emitting case 20 as seen in a vertical direction.

In an inventive aspect according to claim 3, in the blow-by gas heating apparatus according to claim 2, the height of the inner surface 22B of the ceiling wall 22 is set to be highest at an outlet part 24 for cooling water.

In an inventive aspect according to claim 4, in the blow-by gas heating apparatus according to claim 3, the outlet part 24 has an outlet pipe 24A led below the heat emitting case 20. An upper edge 24*a* of the outlet pipe 24A is set at a position second highest to a site 27*a* of the outlet part 24 in the inner surface 22B of the ceiling wall 22.

In an inventive aspect according to claim 5, in the blow-by gas heating apparatus according to one of claims 3 and 4, the heat emitting case 20 is set to be branched shaped as seen in a vertical direction, with a lateral clearance recess 25 for avoiding a downward oil outlet 9*c* of the oil separator 9. At one end and other end of the heat emitting case 20 in a circumferential direction as seen in a vertical direction, an inlet part 23 for cooling water and the outlet part 24 are respectively provided.

Effects of the Invention

According to the present invention, the heat emitting case and the bottom surface of the oil separator are in surface-contact with each other over a large area, thereby efficiently transferring heat of the heat emitting structure from the heat emitting case to the oil separator. Thus, heat is transferred to the case bottom where water gathers, whereby the frozen portion quickly thaws and its temperature rises. Further, by virtue of heat being transferred upward, the entire oil separator is efficiently warmed. The heat emitting structure uses the cooling water which is an existing element. Therefore, the present invention is preferable also in terms of reasonable means such as low cost and space saving.

As a result, the present invention provides, as a further improvement of the technique of minimizing or preventing excessive cooling of an oil separator, an effective blow-by gas heating apparatus which minimizes or solves the problems due to frozen blow-by gas in an engine externally equipped with an oil separator.

EMBODIMENTS OF THE INVENTION

In the following, with reference to the drawings, a description will be given of an embodiment of a blow-by gas heating apparatus of the present invention applied to an industrial inline multi-cylinder diesel engine such as an agricultural tractor engine. Hereinafter, it is defined that, with reference to the direction of a crankshaft 1K, the side on which a flywheel housing 7 is mounted is rear; the side opposite thereto is front; the side where an intake manifold 8 is mounted is left; and the side where an exhaust manifold 10 is mounted is right.

Figure 8:
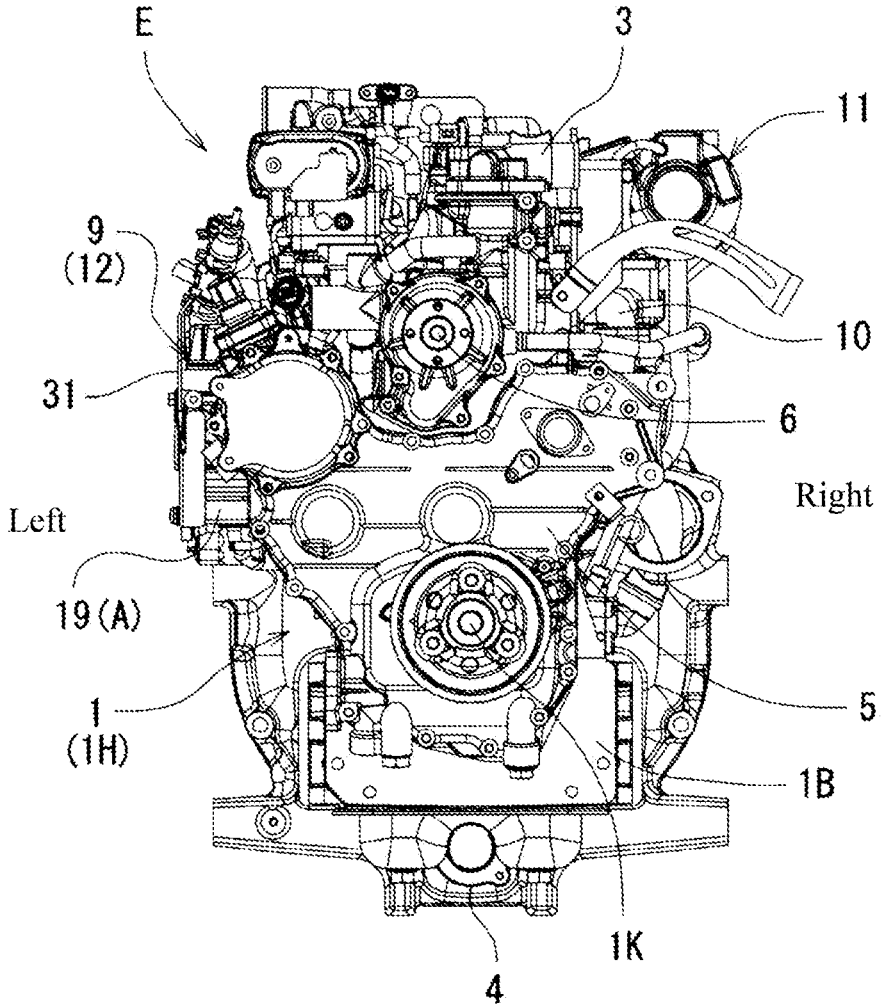
FIG. 8 is a front view of an inline multi-cylinder diesel engine.
Figure 9:
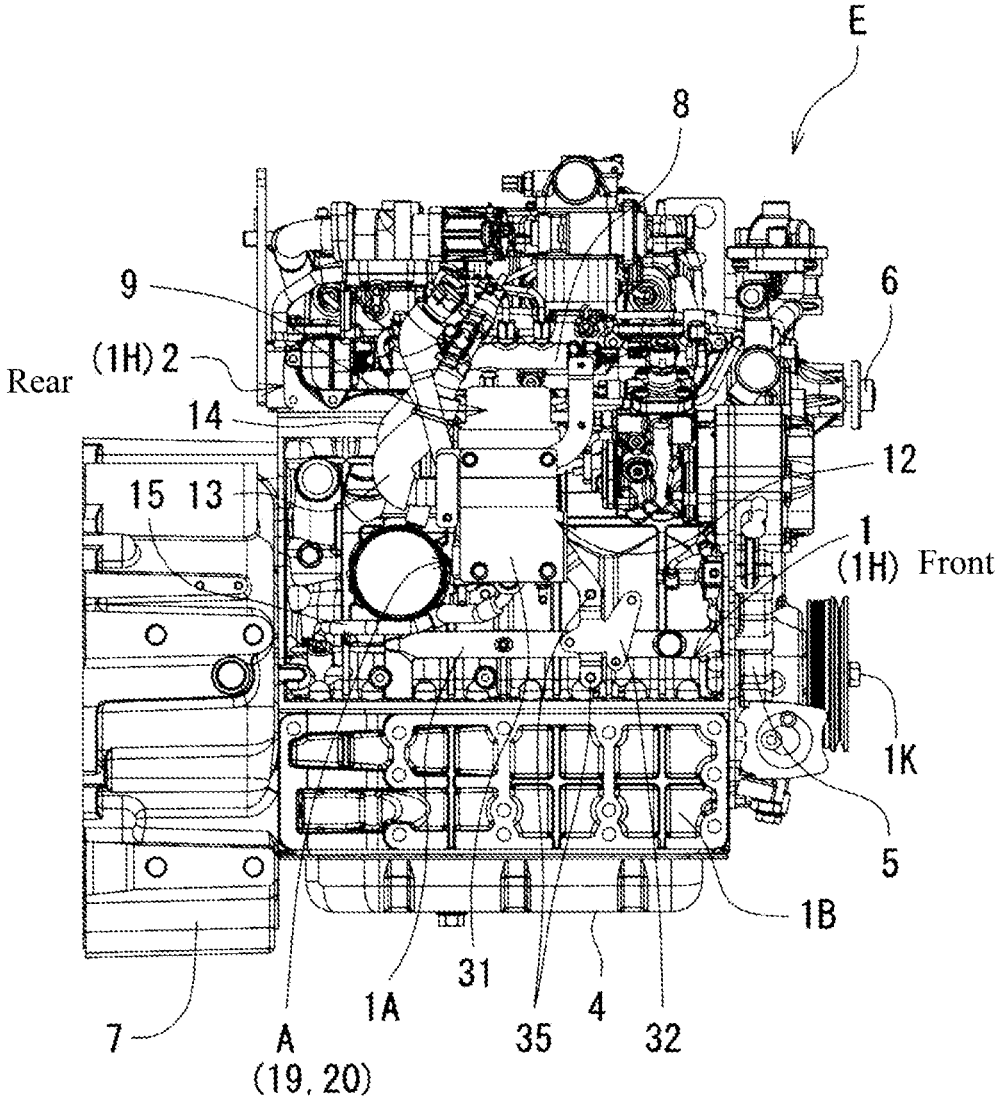
FIG. 9 is a left side view of the engine shown in FIG. 8.
Figure 10:
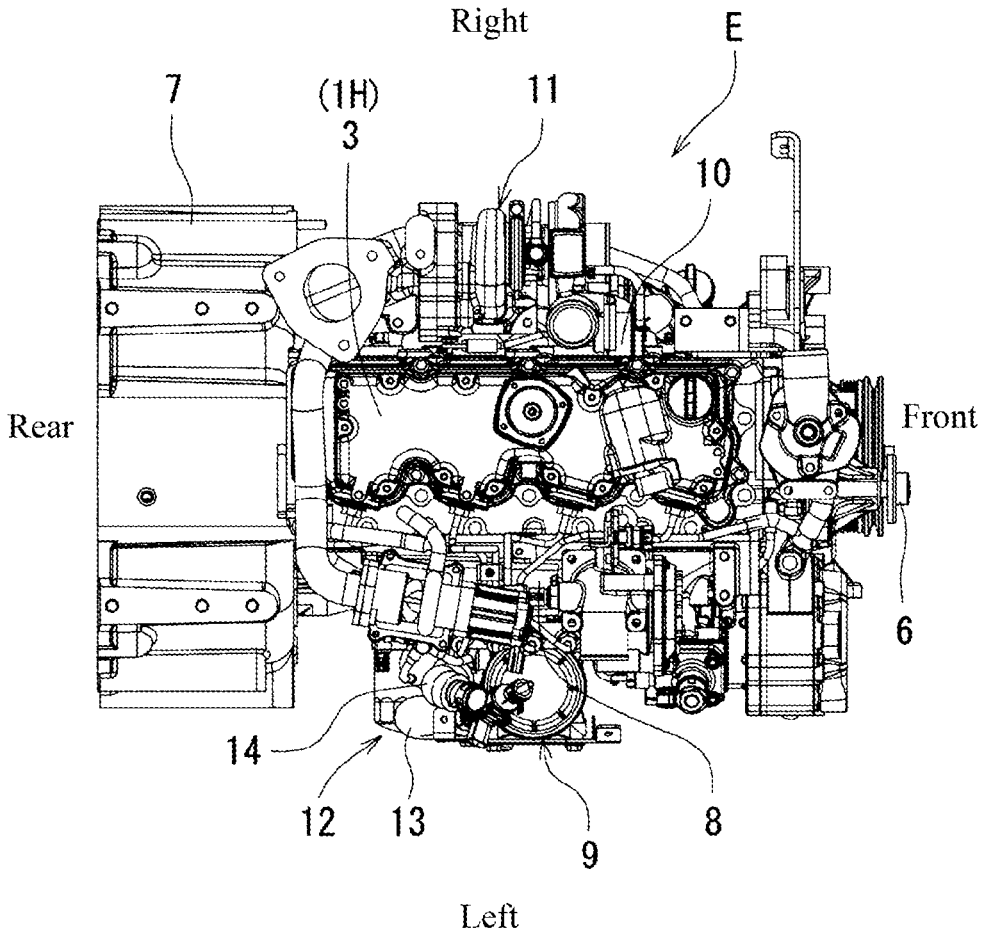
FIG. 10 is a plan view of the engine shown in FIG. 8.

As shown in FIGS. 8 to 10, an engine E includes: a cylinder head 2 mounted on the upper part of a cylinder block 1; a head cover (cylinder head cover) 3 mounted on the upper part of the cylinder head 2; and an oil pan 4 mounted on the lower part of the cylinder block 1. A transmission case 5 is mounted on the front end of the cylinder block 1. A cooling fan shaft 6 including an engine cooling fan (not shown) is disposed at the front part of the transmission case 5. A flywheel housing 7 housing a flywheel is disposed at the rear part of the cylinder block 1.

The upper half part of the cylinder block 1 forms a cylinder portion 1A, and the lower half part of the cylinder block 1 forms a crankcase 1B. The crankshaft is denoted by 1K. On the left side of the cylinder head 2, an intake manifold 8 and an oil separator 9 are disposed. On the right side of the cylinder head 2, an exhaust manifold 10, a supercharger 11 and the like are disposed. The engine E is equipped with a blow-by gas return apparatus 12 that returns blow-by gas generated in the crankcase 1B to an intake passage Q. Note that, the cylinder block 1, the cylinder head 2, and the head cover 3 are collectively referred to as an engine body 1H.

Figure 5:
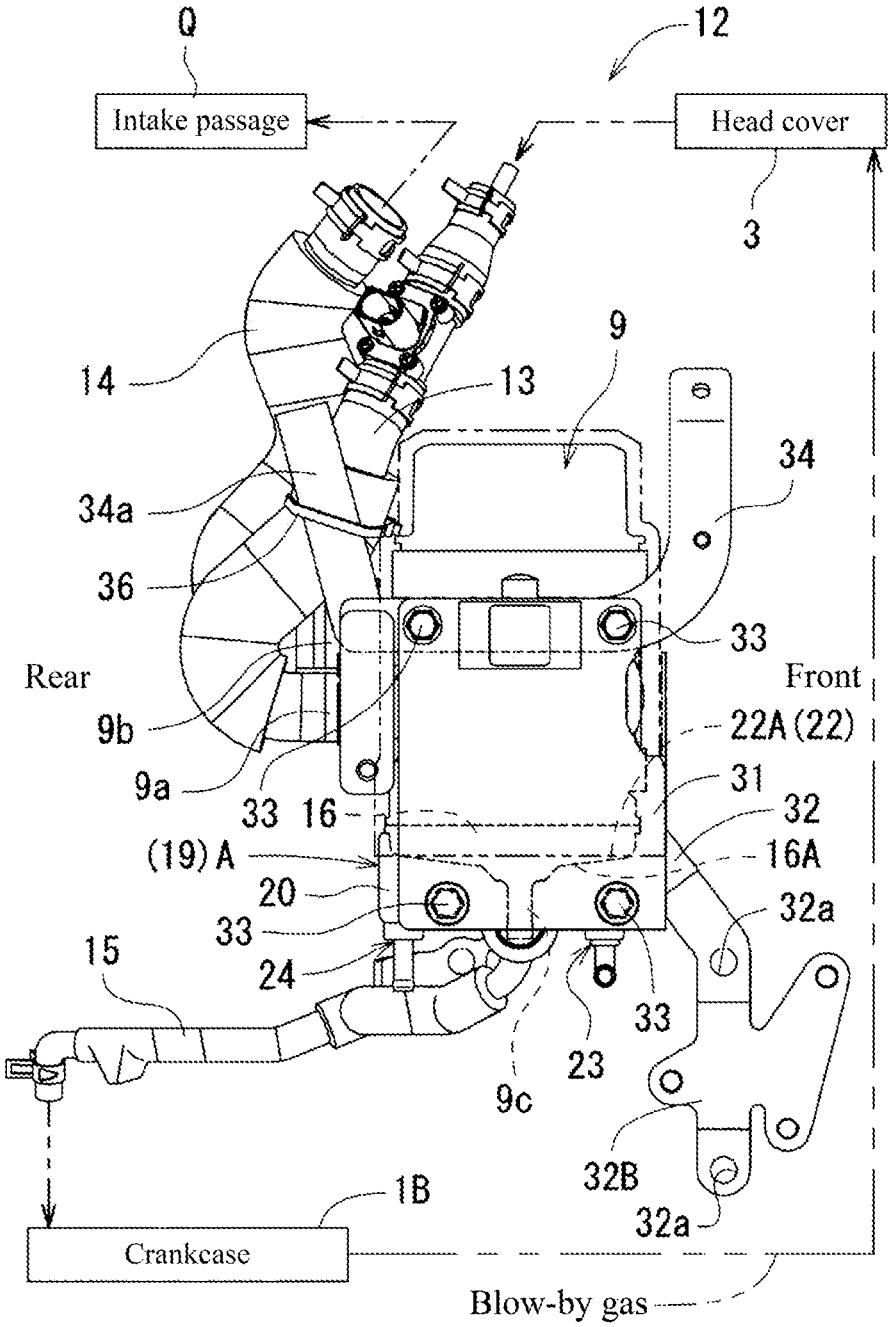
FIG. 5 is a left side view of a heating apparatus-equipped oil separator ASSY.

As shown in FIG. 5, the engine E is equipped with the blow-by gas return apparatus 12 that removes any oil component from blow-by gas generated in the crankcase 1B and thereafter returns the blow-by gas to the intake passage Q. The intake passage Q may be the intake manifold 8 (or its main tube), the supercharger 11 and the like. The blow-by gas return apparatus 12 includes the oil separator 9 that traps and removes oil from blow-by gas, and a blow-by gas heating apparatus A capable of heating (warming) the oil separator 9. That is, blow-by gas from which oil (any liquid component) is mostly removed by the oil separator 9 is returned to the intake passage Q through a downstream pipe 14 on the returning side.

Figure 6:
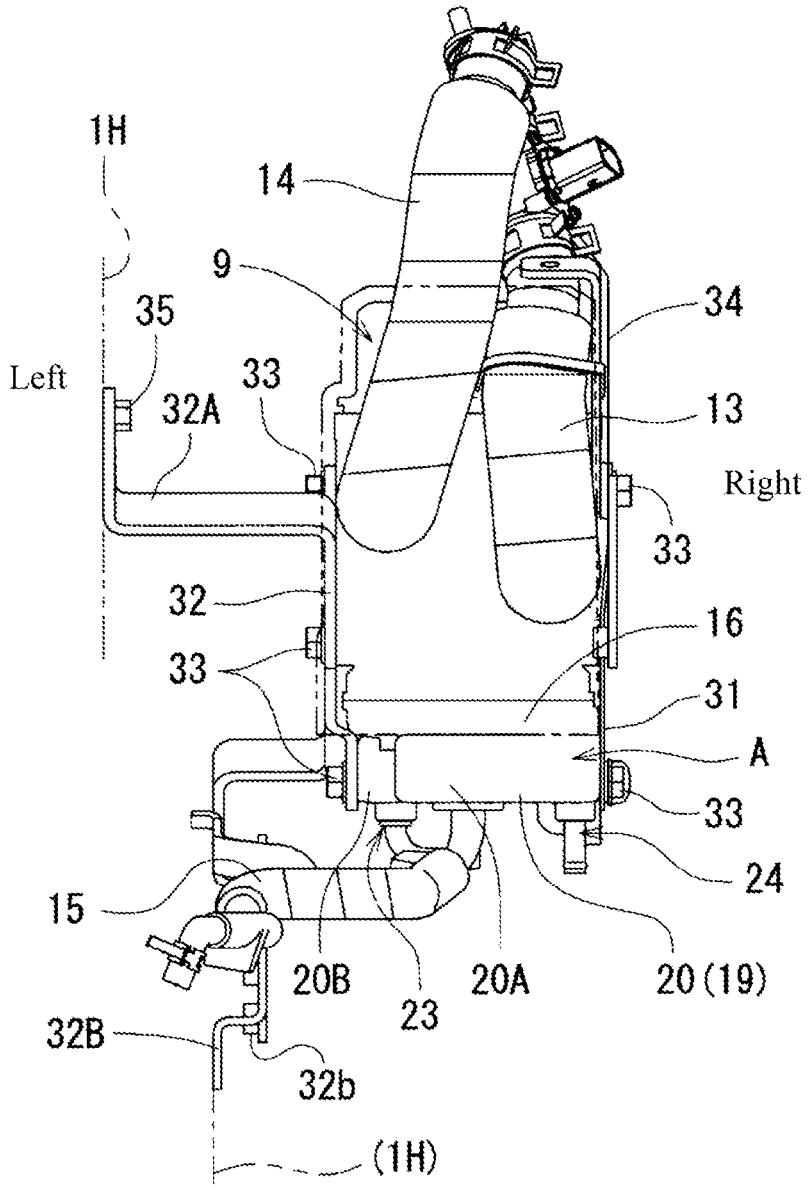
FIG. 6 is a rear view of the heating apparatus-equipped oil separator ASSY.
Figure 7:
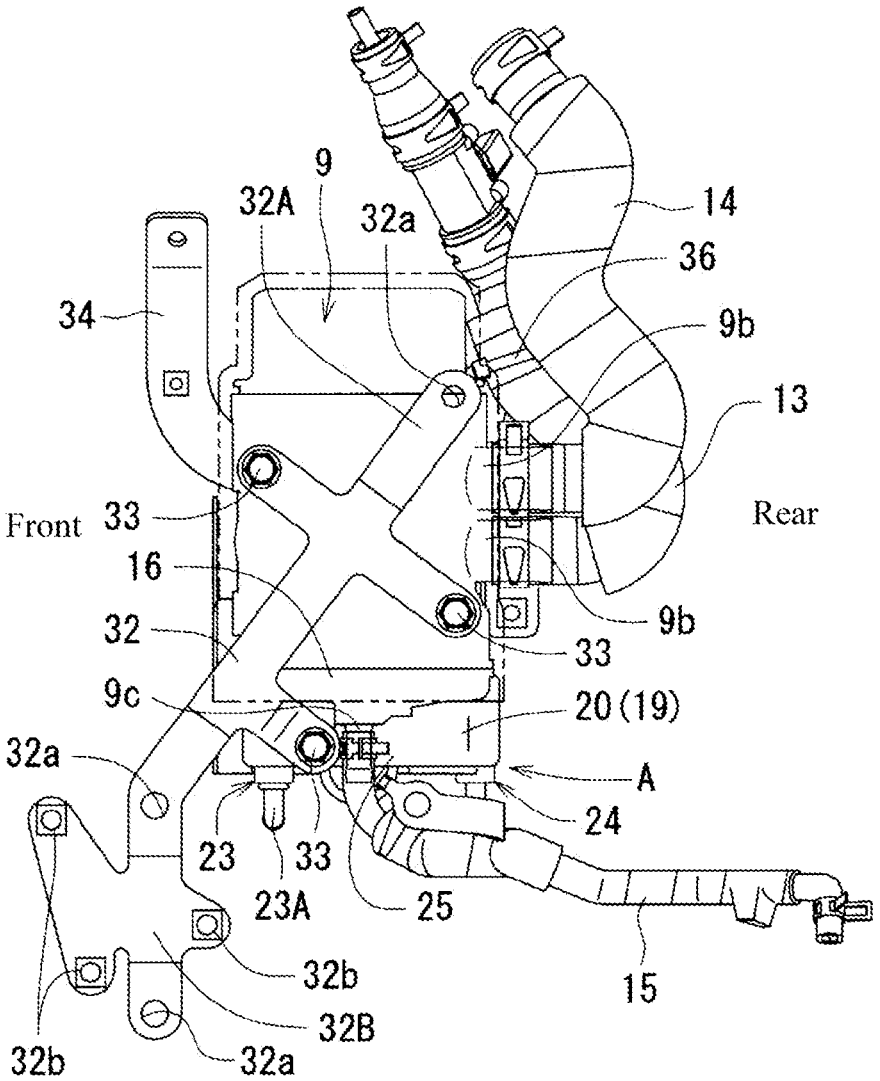
FIG. 7 is a right side view of the heating apparatus-equipped oil separator ASSY.

As shown in FIGS. 5 to 7, the oil separator 9 includes a separator case having a blow-by gas inlet part 9*a* communicating with the head cover 3 via an upstream pipe 13, a blow-by gas outlet 9*b* communicating with the intake passage Q via the downstream pipe 14, and an oil outlet 9*c* for discharging oil (engine oil) trapped and collected from blow-by gas. The separator case houses at least a filter (not shown) capable of trapping and removing any liquid component from blow-by gas. To the oil outlet 9*c*, an oil return passage 15 formed by a pipe or the like is connected so as to establish communication, so that the oil collected by the oil separator is returned to the inside of the crankcase 1B by gravity.

Figure 3:
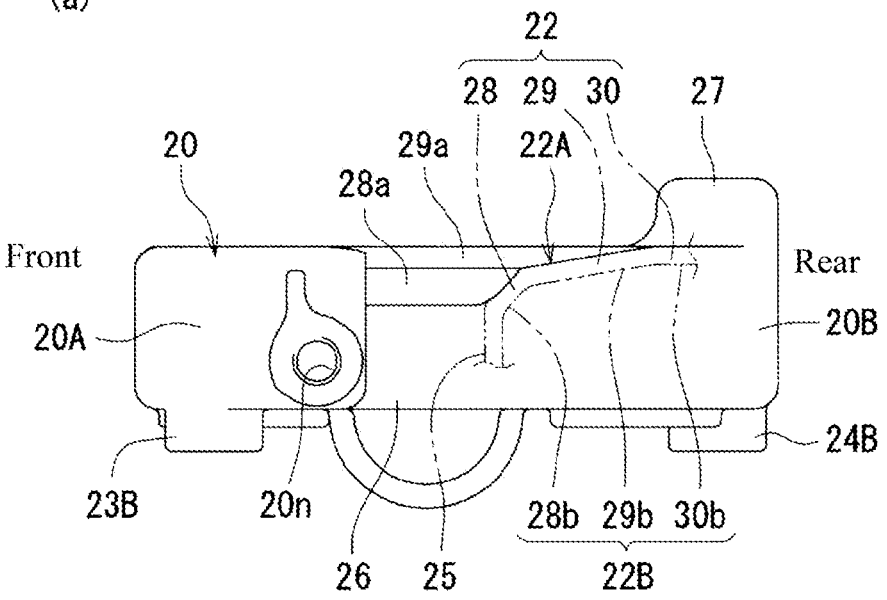
FIG. 3 shows the heat emitting case, in which (a) is a right side view, and (b) is a cross-sectional view taken along line Z-Z in FIG. 2(*a*).
Figure 3:
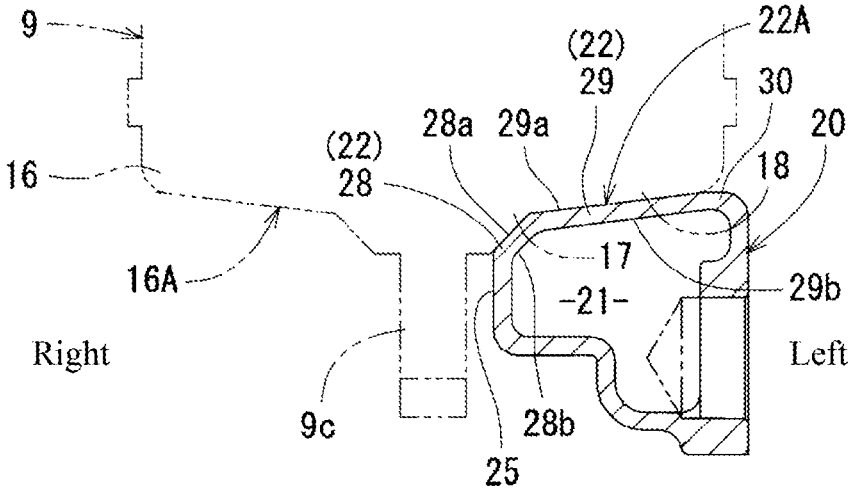

The separator case is circular as seen in a vertical direction. As shown in FIG. 3(*b*), at a case bottom 16 of the separator case, the pipe-like oil outlet 9*c* is disposed at the center as seen in a vertical direction to project downward. The case bottom 16 has a center projection 17 provided with the oil outlet 9*c* at its center and projecting downward, and an inclined bottom peripheral wall 18 around the center projection 17. The inclined bottom peripheral wall 18 is inclined so that the height of the lower surface rises from the central part toward the peripheral part. That is, the case bottom 16 is formed as a stepped bowl-like bottom peripheral wall about the oil outlet 9*c*. The case bottom 16 has an inner bottom surface (not shown) which becomes lower toward the oil outlet 9*c* disposed at the center surrounded by the front, rear, right and left sides.

That is, oil (specifically, any liquid component including oil and water) collected inside the separator case shifts downward in the separator case and flows on the inner bottom surface (not shown), which is the inner surface of the case bottom 16, toward the oil outlet 9*c*.

Accordingly, in an extremely low temperature condition, the oil separator 9 tends to freeze starting from the case bottom 16 where moisture gathers.

Next, a description will be given of a blow-by gas heating apparatus A. As shown in FIGS. 1, 5 to 7, the blow-by gas heating apparatus A has a heater (exemplary heat emitting structure) 19 closely abutting onto a bottom surface 16A of the oil separator 9. The heater 19 has a heat emitting case 20 including therein a passage 21 for engine cooling water, an inlet pipe 23A for cooling water attached to the heat emitting case 20, and an outlet pipe 24A. The heat emitting case 20 includes a ceiling wall 22 that is in surface-contact from below with the bottom surface 16A of the oil separator 9.

As shown in FIGS. 1 to 4, the heat emitting case 20 is formed to be a box made of metal (e.g., aluminum alloy) having the ceiling wall 22 including an upper surface 22A conforming to the shape of the bottom surface 16A of the oil separator 9, a horizontal bottom wall 26, and the passage 21 for cooling water which is the inner space of the case. The heat emitting case 20 is set to have a branched shape (a C-shape, an inverted C-shape) as seen in a vertical direction, with a lateral clearance recess 25 for avoiding interference with the downward oil outlet 9*c* of the oil separator 9. At the right front end of the heat emitting case 20 (one end in the circumferential direction as seen in a vertical direction), an inlet part 23 for cooling water is provided. At the left rear end of the heat emitting case 20 (other end in the circumferential direction as seen in a vertical direction), an outlet part 24 is provided.

The inlet part 23 includes an L-shaped inlet pipe 23A opening at the bottom surface of the passage 21, and an inlet supporting part 23B for attaching the inlet pipe 23A to the bottom wall 26. The tip of the inlet pipe 23A is led in the left direction, so as to avoid interference between the inlet pipe 23A including any pipe connected to the inlet pipe 23A and the oil outlet 9*c*. For example, to the inlet pipe 23A, the return route for cooling water having passed through the cylinder head 2 and the like is connected so as to establish communication.

Figure 4:
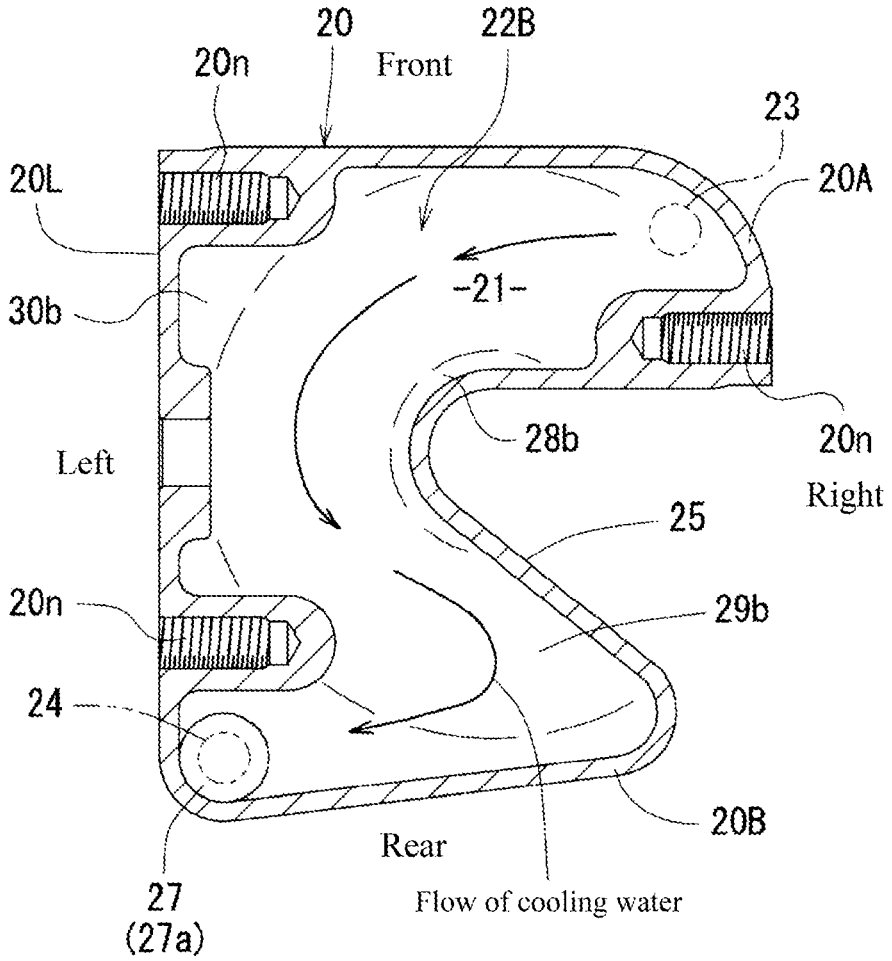
FIG. 4 is a cross-sectional view of the heat emitting case taken along line Y-Y in FIG. 2(*b*).

As shown in FIG. 4, the cooling water in the passage 21 flows from the inlet part 23 toward the outlet part 24, along the S-shaped route formed by a circumferential route and an inverted curved route.

The outlet part 24 includes a linear outlet pipe 24A extending downward, and an outlet supporting part 24B for supporting and fixing the outlet pipe 24A to the bottom wall 26. In the ceiling wall 22 corresponding to the outlet pipe 24A as seen in a vertical direction, the passage 21 at that corresponding portion forms an upper projection 27 projecting upward, and an upper edge 24*a* of the outlet pipe 24A is provided at a position higher than the ceiling wall 22 excluding the upper projection 27. For example, to the outlet pipe 24A, the pipe for cooling water flowing toward the returning port of a radiator is connected so as to establish communication.

Figure 1:
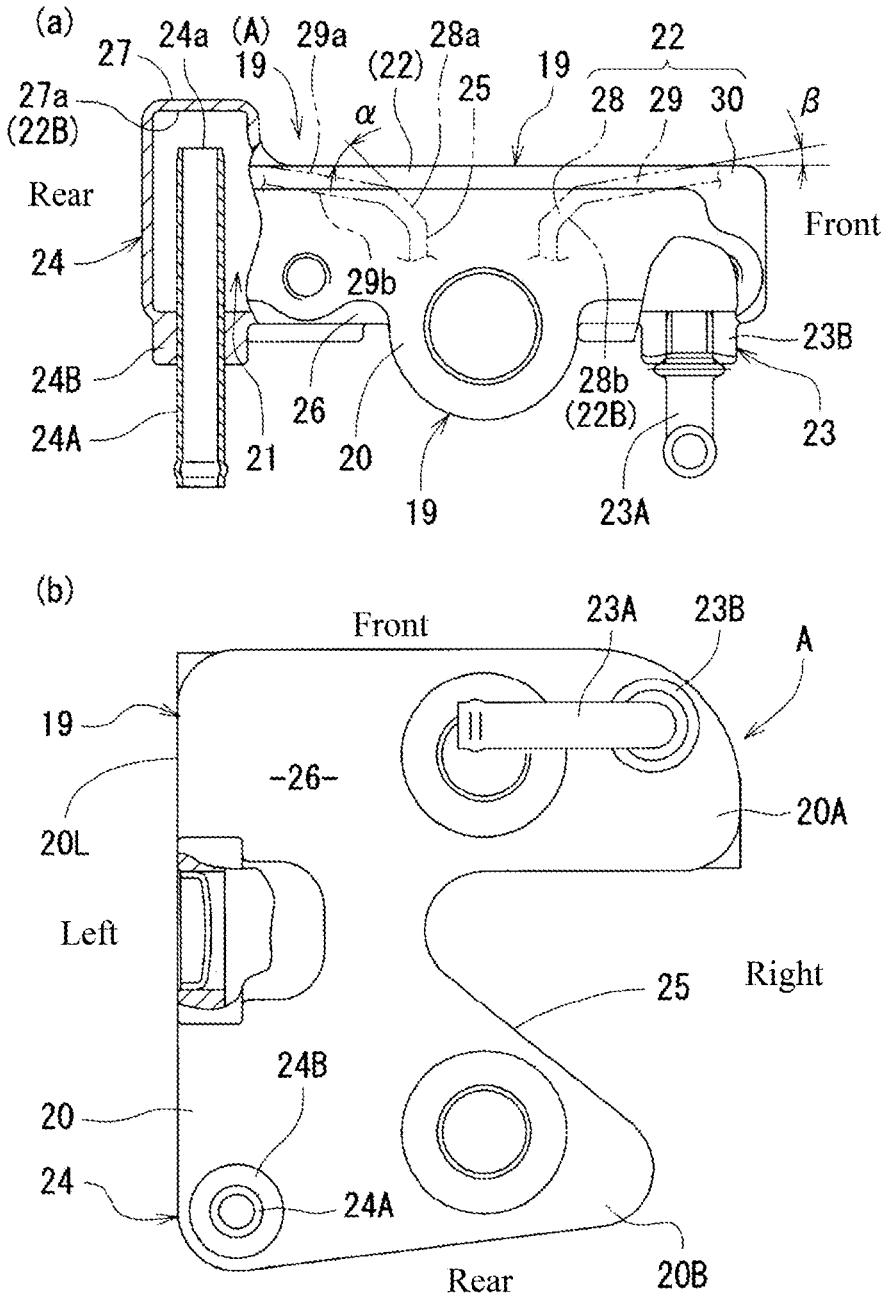
FIG. 1 shows a heater, in which (a) is a partially cutaway left side view, and (b) is a bottom view.
Figure 2:
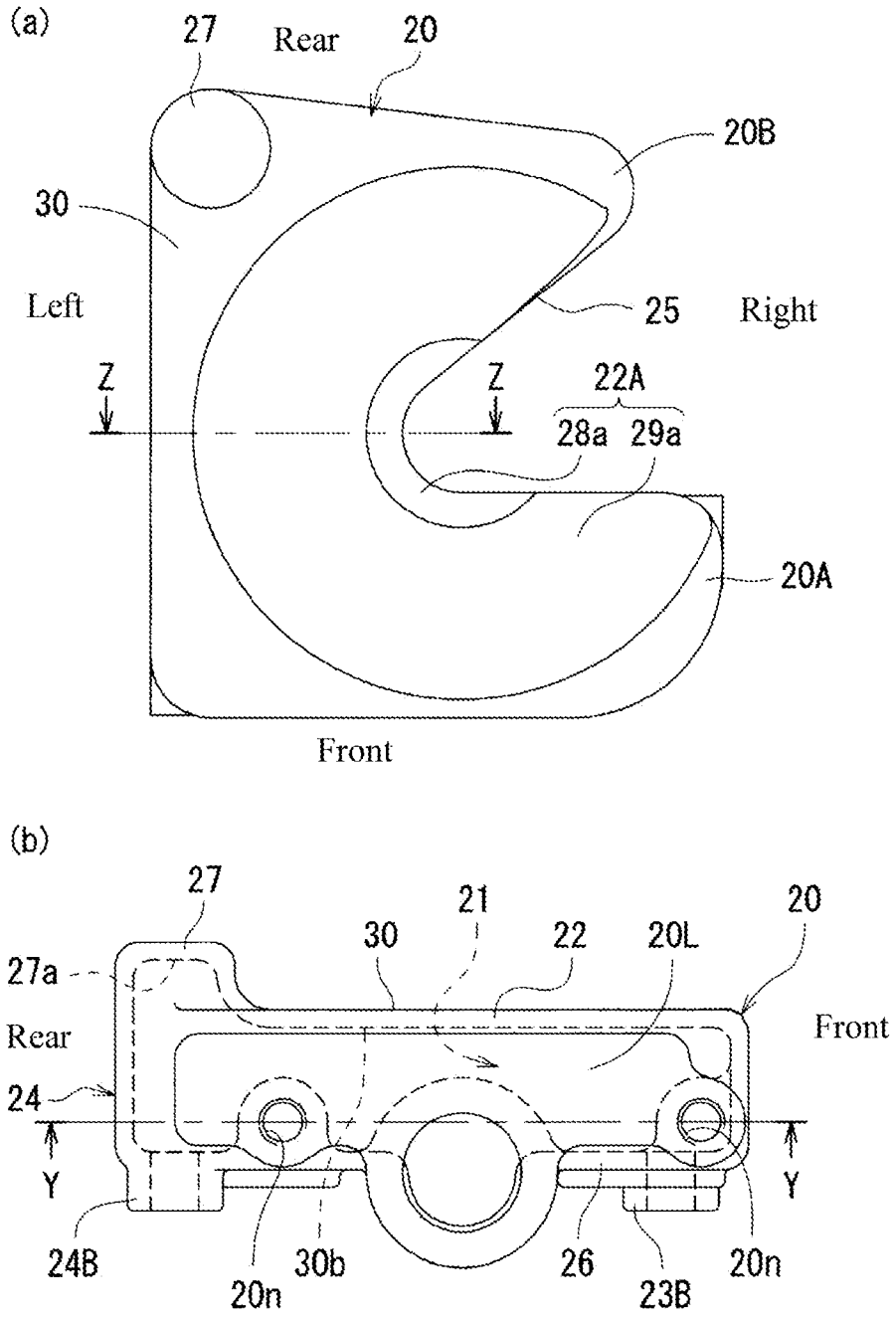
FIG. 2 shows a heat emitting case, in which (a) is a plan view, and (b) is a left side view.

As shown in FIGS. 1 to 3, the ceiling wall 22 of the heat emitting case 20 has a central upper wall part 28 which is the basal site of the clearance recess 25 where the oil outlet 9*c* is disposed and which is inclined sharply by an angle $\alpha$ (e.g., 45 degrees), a main upper wall part 29 continuous to the outer peripheral side of the central upper wall part 28 and inclined mildly by an angle of $\beta$ (e.g., 7 to 8 degrees), and a horizontal outer upper wall part 30 continuous to the outer peripheral side of the main upper wall part 29.

An upper surface 28*a* of the central upper wall part 28 and an upper surface 29*a* of the main upper wall part 29 structure the upper surface 22A capable of being closely in surface-contact with the bottom surface 16A of the oil separator 9.

An inner surface 22B of the ceiling wall 22 which is the ceiling surface of the passage 21 is formed by a lower surface 28*b* of the central upper wall part 28, a lower surface 29*b* of the main upper wall part 29, and a lower surface 30*b* of the outer upper wall part 30. That is, the height of the inner surface 22B of the ceiling wall 22 increases from the central part toward the peripheral part of the heat emitting case 20 as seen in a vertical direction. The height of the inner surface 22B is set to be highest at the outlet part 24 for the cooling water, that is, at the upper projection 27.

As shown in FIG. 1, the upper edge 24*a* of the outlet pipe 24A is set at a position second highest to the lower surface 27*a* of the upper projection 27, which lower surface 27*a* is the site of the outlet part 24 in the inner surface 22B of the ceiling wall 22. These elements in the inner surface 22B of the ceiling wall 22 are in the following descending order of height: the lower surface 27*a* of the upper projection 27>the upper edge 24*a* of the outlet pipe 24A>the lower surface 30*b* of the outer upper wall part 30>the lower surface 29*b* of the main upper wall part 29>the lower surface 28*b* of the central upper wall part 28.

The operation and effect of the blow-by gas heating apparatus A are as follows. The ceiling wall 22 of the heat emitting case 20 and the oil separator 9 are in surface-contact with each other, over a large area between a group including the upper surface 28*a* of the central upper wall part 28 and the upper surface 29*a* of the main upper wall part 29, and other group including the center projection 17 and the inclined bottom peripheral wall 18. Thus, heat generated by the heater 19 is efficiently transferred to the oil separator 9 from the heat emitting case 20.

Heat is transferred to the case bottom 16 where water gathers, whereby the frozen portion quickly thaws and its temperature rises. Further, by virtue of heat being transferred upward, the entire oil separator 9 is efficiently warmed.

The heater 19 is configured to generate heat by allowing cooling water, which is warmed by the engine being started, to pass through the heat emitting case 20. That is, the heater 19 is implemented by effectively using an existing engine element. Therefore, the present embodiment can dispense with any dedicated heat source, and provides the blow-by gas heating apparatus A capable of heating blow-by gas by cost-effective and space-saving reasonable means.

The passage 21 is formed C-shaped, having the inlet part 23 and the outlet part 24 disposed at its opposite ends. Therefore, cooling water which is the heat source smoothly flows from the inlet part 23 to the outlet part 24, and the heat is efficiently transferred to the heat emitting case 20. Provided that air that adversely affects heat transfer enters the heat emitting case 20, the air is carried by the cooling water to the outlet part 24 and discharged. Additionally, the inner surface 22B of the ceiling wall 22 becoming higher outward is advantageous in that, air shifts toward the outer peripheral side while flowing in the passage 21, and is easily and thoroughly discharged from the outlet pipe 24A whose upper edge 24*a* is at the highest position and positioned on the outer side in the radial direction than the bottom surface (the case bottom 16) of the oil separator 9. It goes without saying that the upper projection 27 is also positioned on the outer side in the radial direction than oil separator 9.

By virtue of the heat emitting case 20 including the clearance recess 25 which is not continuous around the oil outlet 9*c*, the passage 21 forms a single-system route, realizing smooth flow of cooling water. Additionally, in the state where any pipe is connected to the oil outlet 9*c*, shifting laterally in the clearance recess 25 direction advantageously allows the heater 19 to be attached to or removed from the oil separator 9. Further, the clearance recess 25 allows the heater 19 to be supported by the engine body 1H while avoiding interference with any projection of the engine body 1H and any other disposed components.

Next, a description will be given of the integration structure between the oil separator 9 and the blow-by gas heating apparatus A, and the attachment structure to the engine body 1H.

As shown in FIGS. 5 to 7, the oil separator 9 and the heater 19 are integrated to each other using a first coupling member 31 screwed across respective right surfaces of the oil separator 9 and the heater 19, and a second coupling member 32 screwed across respective left surfaces of the oil separator 9 and the heater 19.

As shown in FIG. 5, the first coupling member 31 is formed of a quadrangular steel plate, and screwed to the right surface of the oil separator 9 with two bolts 33, and to the left surface 20L of the heat emitting case 20 with two bolts 33. Nut parts 20*n* for the bolts 33 at the heat emitting case 20 are formed to extend in the passage 21.

The upper two bolts 33 for attaching the first coupling member 31 join the first coupling member 31 and supporting hardware 34 formed of a steel plate. The upstream pipe 13 is supported by a fastening band 36 at a rear upward extending piece 34*a* of the supporting hardware 34. The supporting hardware 34 is configured to function as a supporting component for other engine accessories.

As shown in FIGS. 5 to 7, the second coupling member 32 formed of a steel plate having a greater thickness than the first coupling member 31 is fixed with the bolts 33 at two locations in the left surface of the oil separator 9, and fixed with the bolt 33 at one nut part 20*n* formed at the right surface of an inlet-side extending part 20A (see FIG. 4) of the heat emitting case 20. The right side of an outlet-side extending part 20B (see FIG. 4) of the heat emitting case 20 is left free.

Mounting holes 32*a* are formed at one location in a bent upper end 32A of the second coupling member 32, and two locations in a folded lower end 32B. Bolts 35 (see FIGS. 7, 9) inserted to these three mounting holes 32*a* attach and fix the second coupling member 32 to the left surface of the engine body 1H. Further, three nut parts 32*b* formed at lower end of the second coupling member 32 are configured to be capable of attaching also other engine accessories.

Other Embodiment

The heat emitting case 20 may be formed to annularly continuously surround the oil outlet 9*c*. Alternatively, the heat emitting case 20 may be formed across the lateral surfaces on the front, rear, right, and left side of the oil separator 9 (to have a U-shaped cross section).

DESCRIPTION OF REFERENCE SIGNS

9: Oil separator
9*c*: Oil outlet
16A: Bottom surface
19: Heater (Heat emitting structure)
20: Heat emitting case
21: Passage for engine cooling water
22: Ceiling wall
22B: Inner surface
23: Inlet part
24: Outlet part
24A: Outlet pipe
24*a*: Upper edge of outlet pipe
25: Clearance recess
27*a*: Site of outlet part in inner surface
A: Blow-by gas heating apparatus

The invention claimed is:

1. A blow-by gas heating apparatus comprising a heat emitting structure abutted onto an oil separator configured to trap and remove oil from blow-by gas, wherein the heat emitting structure has a heat emitting case including inside a passage for engine cooling water, and the heat emitting case includes a ceiling wall being in surface-contact from below with a bottom surface of the oil separator, a height of an inner surface of the ceiling wall is configured to increase from a central part toward a peripheral part of the heat emitting case as seen in a vertical direction, and the ceiling wall includes an upper surface conforming to a shape of the bottom surface and closely abuts onto the bottom surface.

2. The blow-by gas heating apparatus according to claim 1, wherein the height of the inner surface of the ceiling wall is set to be highest at an outlet part for cooling water.

3. The blow-by gas heating apparatus according to claim 2, wherein the outlet part has an outlet pipe led below the heat emitting case, and an upper edge of the outlet pipe is set at a position second highest to a site of the outlet part in the inner surface of the ceiling wall.

4. The blow-by gas heating apparatus according to claim 2, wherein the heat emitting case is set to be branched shaped as seen in a vertical direction, with a lateral clearance recess for avoiding a downward-oriented oil outlet of the oil separator, and at one end and other end of the heat emitting case in a circumferential direction as seen in a vertical direction, a cooling water inlet part and the outlet part are respectively provided.

* * * * *